United States Patent [19]

Clevett et al.

[11] Patent Number: 4,628,560

[45] Date of Patent: Dec. 16, 1986

[54] EXPANDABLE PORTABLE BRIDGE STRUCTURE

[75] Inventors: Merton L. Clevett, Littleton; Robert H. Lowdermilk, Denver; John K. Bright, Golden, all of Colo.; Clifford S. Coulter, 9940 W. 81st Dr., Arvada, Colo. 80005; Tommy W. Melton, 9439 W. Burgundy Ave., Littleton, Colo. 80123

[73] Assignee: Fastspan, Inc., Englewood, Colo. ; by said Merton Clevett, Robert Lowdermilk, and John Bright

[21] Appl. No.: 583,839

[22] Filed: Feb. 27, 1984

[51] Int. Cl.[4] ..... E01D 15/12

[52] U.S. Cl. ..... 14/2.4; 14/27; 52/109; 211/202

[58] Field of Search ..... 14/2.4, 2.6, 3, 17, 14/9, 10, 27, 45, 1, 18, 22, 73; 211/202; 52/109, 645, 646; 446/476, 478, 487, 111, 113

[56] References Cited

U.S. PATENT DOCUMENTS

| | | | |
|---|---|---|---|
| 892,686 | 7/1908 | Schneider et al. | 52/109 |
| 2,878,498 | 3/1959 | Gollnow | 14/3 X |
| 3,152,347 | 10/1964 | Williams | 52/109 |
| 3,375,624 | 4/1968 | Mikulin | 52/109 |
| 3,593,481 | 7/1971 | Mikulin | 50/632 |
| 3,877,544 | 4/1975 | McCollum | 52/109 X |
| 4,411,036 | 10/1983 | Fitzgerald-Smith | 14/2.4 |
| 4,457,035 | 7/1984 | Habegger et al. | 14/18 |

FOREIGN PATENT DOCUMENTS

| | | | |
|---|---|---|---|
| 65502 | of 1914 | Austria | 14/3 |
| 241 | of 1853 | United Kingdom | 14/27 |
| 152407 | 10/1920 | United Kingdom | 14/1 |

OTHER PUBLICATIONS

The Denver Post, article entitled "Inventor Keeps Ideas Simple to Implement" by Alison Lusk, Mar. 4, 1981, p. 2.

"The Windsor Beacon" Windsor, Colorado, vol. 83, Issue No. 45, Jan. 29, 1981.

"The Denver Post" Denver, Colorado, vol. 89, Mar. 4, 1981.

*Primary Examiner*—Stephen J. Novosad
*Assistant Examiner*—John F. Letchford
*Attorney, Agent, or Firm*—Ralph F. Crandell

[57] ABSTRACT

A transportable pantograph truss bridge structure. The pantograph truss is in the form of an inverted triangle with deck sections incorporating gratings utilized as parallel tracks for wheeled vehicles. The bridge is suitable for rapid deployment in military applications and is portable on a wheeled trailer including erecting masts, cables, and winches. The pantograph truss is formed of sealed tubular elements, so as to be neutrally buoyant. The deck panels are formed in sections with grating formed of metal or of resin impregnated Fiberglas, carbon filaments or the like.

13 Claims, 20 Drawing Figures

EXPANDABLE PORTABLE BRIDGE STRUCTURE

The present invention relates to an improved portable, expandable or collapsible, rapid deployment bridge structure.

BACKGROUND OF THE INVENTION

1. Field of the Invention

The present invention relates to portable prefabricated bridge structures for vehicles and pedestrians. More specifically, the present invention relates to transportable bridge structures including pantograph or lazy tong trusses with insertable deck sections to provide parallel tracks or walkways.

2. Description of the Prior Art

Portable bridges have long been known in the art and find particular utility in military applications. Expandable bridge trusses of the pantograph type are also known, such truss structures having been used for bridges, extension platforms, towers and the like. See for example, U.S. Pat. No. 3,593,481, issued July 20, 1971, to T. Mikulin for "Extensible Structure." Portable, rapid deployment bridge structures are known, usually in the form of bolt together sections.

OBJECTS AND SUMMARY OF THE INVENTION

The principal object of the present invention is to provide an improved, prefabricated, compact, portable self-contained, rapid deployment bridge structure.

A further object of the present invention is to provide a rapid deployment bridge structure of the foregoing character which is light in weight, easily erected and which floats in water, is lightweight and suitable for helicopter suspension and deployment, and is readily erected or dismantled.

Still another object of the present invention is to provide a bridge structure of the foregoing character which is adjustable in length prior to deployment and erection.

Still another object of the present invention is to provide a bridge structure of the foregoing character which is rigid, prestressed and rugged when fully erected, and capable of supporting both pedestrian and vehicles.

Other objects and advantages of the present invention will become apparent as the following description proceeds, taken in conjunction with the accompanying drawings.

The rapid deployment bridge structure together with the transport and erecting apparatus therefore comprises a trailer supporting the bridge structure and adapted to be towed by a truck or tractor, etc. The trailer is in the form of a wheeled platform comprising a chassis defining a bridge supporting bed on an undercarriage with a plurality of wheels and axles. An appropriate draw bar and hitch is provided for engagement with a towing vehicle.

The portable rapid deployment bridge structure comprises pantograph trusses formed of a plurality of inverted triangular sections pivoted together at their respective bases, apexes and intermediate portions of the side legs. The triangular sections are in a generally inverted form, with the apex of each section directed downwardly and connected to the apex of each adjoining section by an adjustable length cable. When in the collapsed position, the truss is supported on the trailer adjacent an erecting mast. A plurality of deck grates or panels are provided for forming the deck of the bridge when the truss is extended. The deck grates are retained in an appropriate box or frame on the trailer for subsequent disposition as a part of the bridge. A second erecting mast is provided together with an erecting cable adapted to extend between the upper ends of vertically disposed spaced masts. The first erecting mast is pivoted adjacent its lower end to the rear or trailing end of the trailer and is erected into an upright position by an appropriate hydraulic, electric, mechanical or cable hoist. The bridge truss is removably mounted on brackets on the mast and is supported thereby in a generally vertical but collapsed position as the mast is raised to a vertical position.

To erect the bridge, the trailer is backed to a point adjacent the bridge erection location. The first mast is raised to a generally vertical position by the hoist to position the pantograph truss or frame for expansion. A second mast is erected vertically at a point adjacent the selected extended end point of the bridge. The cable is stretched between the upper ends of the masts and tightened by a winch carried on the trailer. A cable is generally stored on a drum adjacent the winch. With one end of the expandable pantograph truss supported on the first mast, the second end is suspended from a carrier sheave by appropriate cables or block and tackle. The bridge can then be pulled across a gap, ravine, river or the like, appropriate intermediate carrier sheaves being utilized to suspend a bridge truss. When the bridge has been fully extended, the deck grates are inserted into place between the transverse spaced cross bars of the pantograph truss. The deck sections are tightly wedged into place thereby holding the truss in its extended position and prestressing the truss for subsequent loads. When the bridge truss has been fully assembled by insertion of the deck grates, the assembled truss is released from the first mast and lowered into place onto appropriate pre-constructed abutments.

The pantograph truss is formed of sealed tubular rods or beams arranged together in generally V-shaped sections with the legs of the triangles or V's vertical with a base member extending transversely across the top of the truss. The legs are pivoted at their apex ends and at their base ends as well as intermediate points on the legs of the triangles. This structure provides a pantograph type truss which can be readily extended or collapsed.

To insert the deck grate sections firmly between the transverse rods or beams of the truss, a hydraulic jack is desirably utilized to spread the transverse rods sufficiently to receive the deck grates. Upon releasing the jack, the deck grates are held firmly in position by the tension on the bridge. Bridge tension is adjusted by adjusting the cables at the apex end of the triangular truss frames. In this manner the bridge can be prestressed to provide a slightly upwardly curving arc or arch. (Camber)

After use, the bridge is readily disassembled and packed back onto the trailer for transport to another point of use, by reversing the above procedure.

DESCRIPTION OF THE PREFERRED EMBODIMENT

Figure 1:
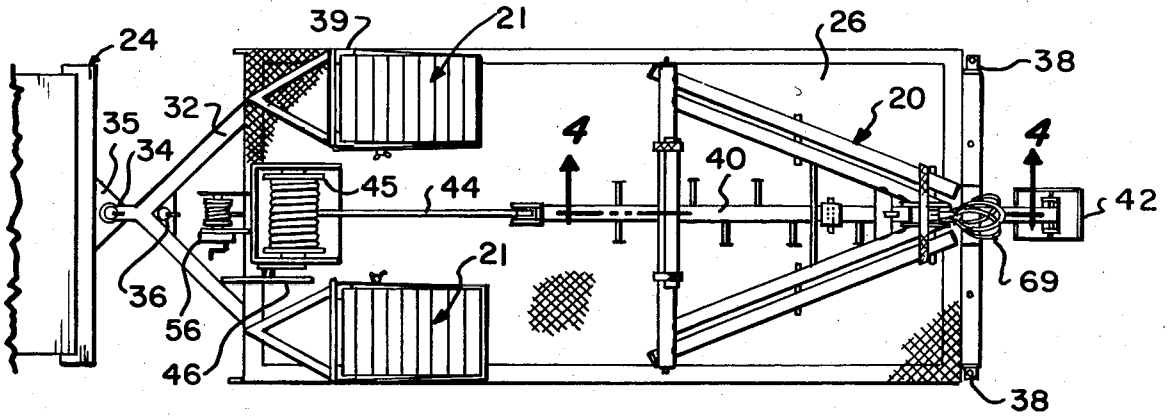
FIG. 1 is a plan view of a trailer and portable bridge assembly embodying the present invention.
Figure 2:
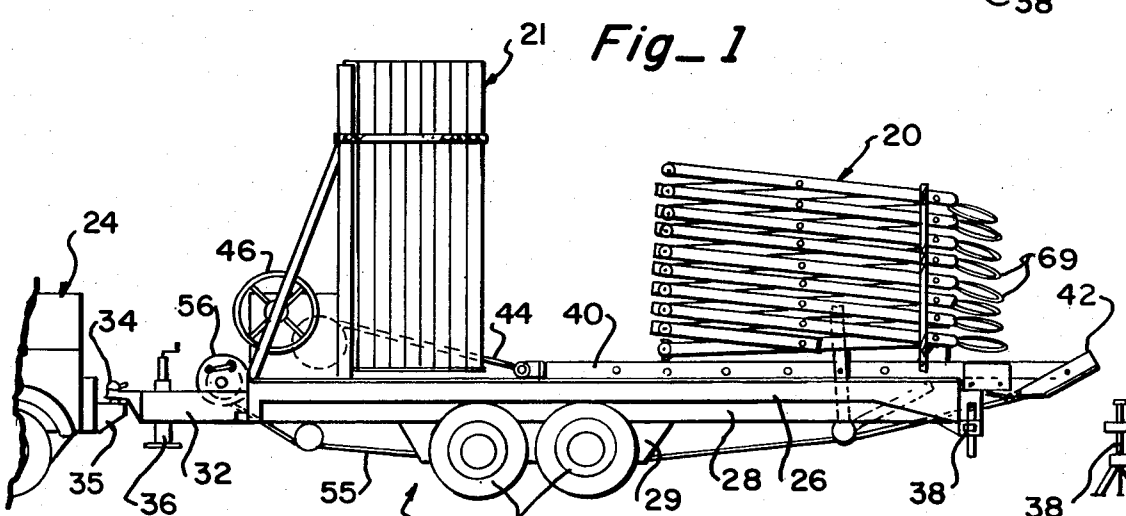
FIG. 2 is a side elevation view of the structure shown in FIG. 1.
Figure 3:
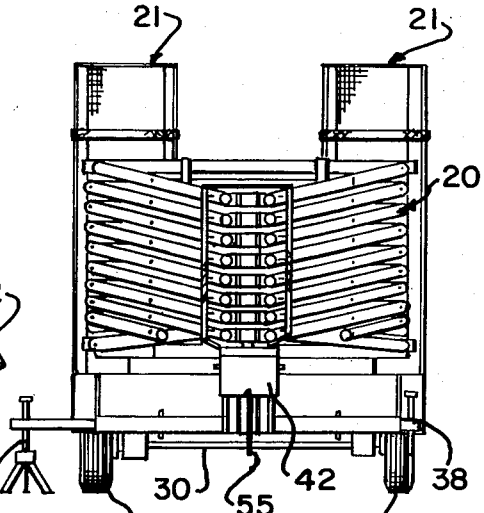
FIG. 3 is a rear elevation view of the structure shown in FIGS. 1 and 2.
Figure 4:
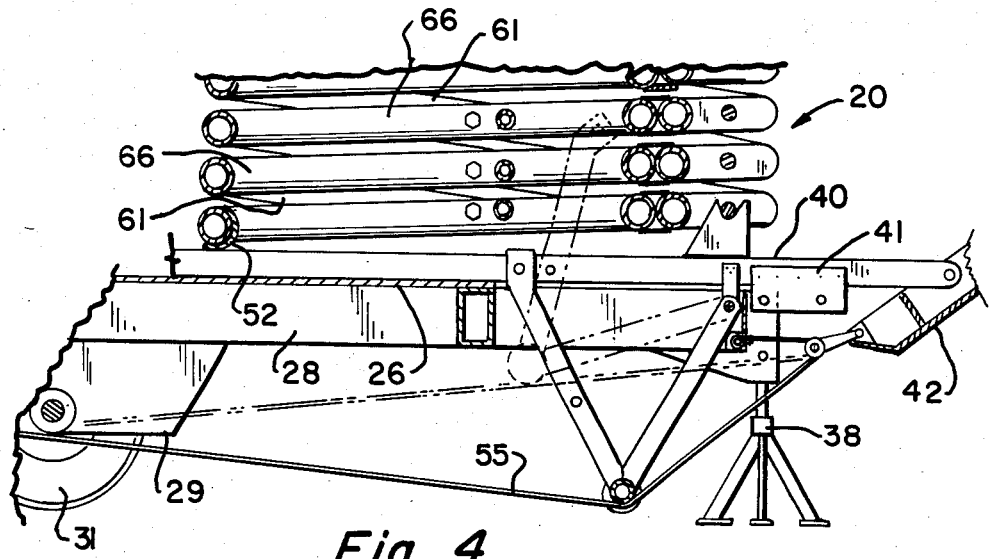
FIG. 4 is an enlarged fragmentary section view taken substantially in the plane of line 4—4 on FIG. 1.

A portable, quickly erectable bridge structure, embodying the present invention is shown in the drawings. The apparatus includes a collapsible and expandable pantograph or lazy tong bridge truss assembly 20, a plurality of deck panels or grates 21, a wheeled trailer assembly 22 adapted to be towed by a dirigible tractor 24, and an erecting mast and cable system 25 carried on the trailer 22 in cooperative association with the pantograph truss assembly 20. While the bridge truss assembly can be of any desired size and length, it is particularly suited for relative short spans of between 50 and 100 feet for supporting vehicles, such as jeeps and trucks or for pedestrian use. Because of its lightweight, rapid erectability, and transportability, the bridge structure finds particular, but not necessarily exclusive utility in military applications. In this regard, the bridge and carrying trailer structure may be driven to a location by a truck or tractor or other vehicle, or may be transported by helicopter. The bridge is also suitable for expansion and erection either by the use of spaced masts and a suspension cable, or by suspension from a helicopter. The bridge will find utility in many applications where a temporary but sturdy portable bridge structure is required.

The trailer assembly 22 for transporting the pantograph truss 20 and deck panels 21 comprises a flat bed 26 supported on a chassis 28 which is in turn mounted on a wheeled undercarriage 29 supported on appropriate axels 30 and wheels 31. The chassis includes a drawbar 32 and hitch 34 adapted for engagement with a corresponding hitch ball mounting 35 at the rear end of a dirigible tractor 24. At its drawbar end, the trailer includes a stabilizing jack 36, and at its trailing end the trailer includes appropriate outrigger supports 38. The bed 26 is preferably formed of expanded metal or a grating in order to preclude the build up of dirt or moisture in event of mud, rain or snow. Supported on the bed adjacent the draw bar end thereof is an appropriate retainer frame or frames 39 for retaining and supporting a plurality of rectangular deck grate panels 21 for use in erecting the bridge.

Extending the length of the bed and pivotally secured to the bed at the trailing end thereof is a first erection mast 40. The mast includes a bracket 41 adjacent its lower end, pivotally mounted to a corresponding bracket on the end of the trailer. At its lowermost ground engaging end, the mast is provided with a foot plate 42, pivotally secured thereon to provide a base and support for the mast on uneven ground. An erecting cable 44 is wound on a drum 45 associated with a winch 46. A second mast 48 is removably carried on the trailer bed and is adapted for erection at a point distant from the first mast, and at the extension point of the truss. The masts are provided with pulleys 49, 50 at their upper end for guiding and supporting the erection cable 44. An appropriate hook is provided on the end of the cable for engaging an eye or bracket on the second erection mast. The drum and winch provides the anchoring point for the opposite end of the cable, which is trained over the pulley 50 on top of the second mast, the pulley 49 atop the first mast, and thence the drum. For storage the cable can be wound onto the drum by the winch. The winch also provides for tensioning the cable during the erection process.

For supporting the pantograph bridge truss assembly, the first mast includes a transverse cross bar 52 adapted to engage one of the transverse members of the truss as will be described.

Figure 5:
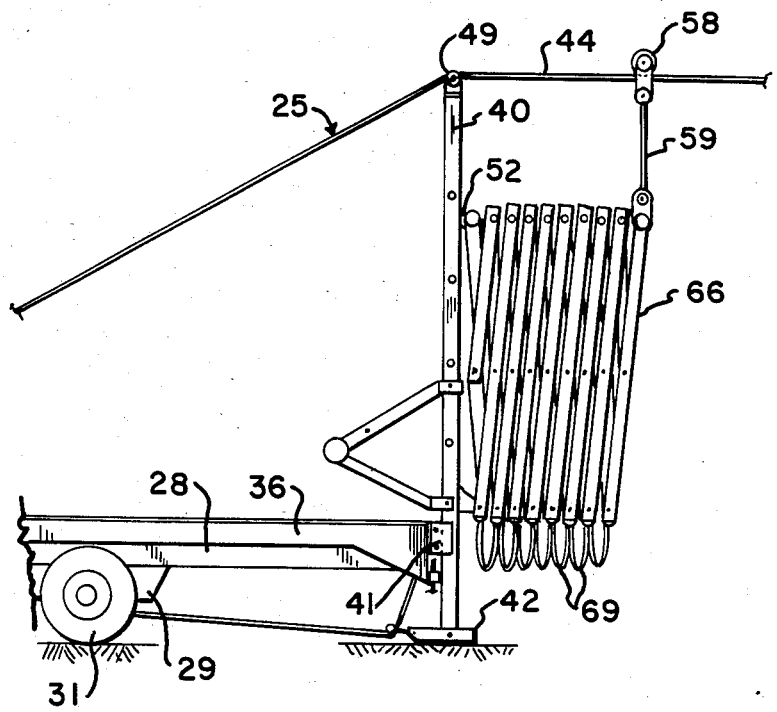
FIG. 5 is a side elevation view of a bridge and trailer assembly of the character shown in FIG. 1, but with the bridge in its initial or raised position prior to erection.
Figure 6:
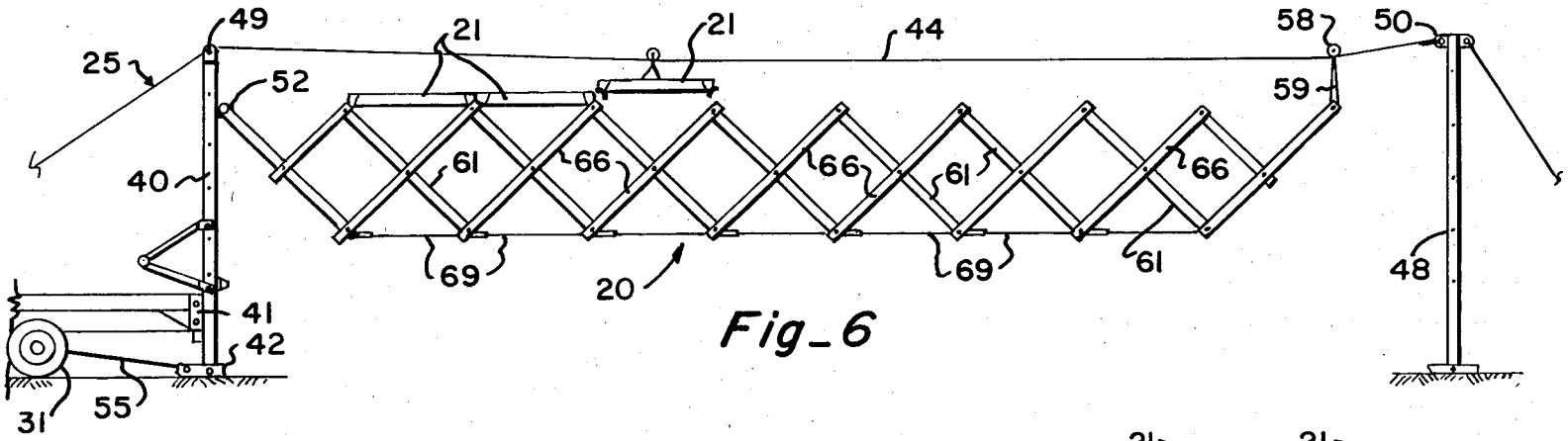
FIG. 6 is an elevation view of the bridge and trailer assembly shown FIG. 1, but with the bridge partially erected

For raising the first mast into operative position, with the cross bar 52 supporting the pantograph truss assembly 20, a hyraulic or screw driven hoist (not shown) may be utilized or a simple erecting cable 55 secured between a small winch 56 on the trailer and the end of the mast below the trailer pivot point, can be employed. By tightening the cable 55, the mast 40 is swung upwardly to a generally vertical position as shown in FIG. 5. The second mast is then erected in a vertical position at a point spaced from the first mast and the cable 44 is suspended between the upper ends of the first and second masts as shown in FIG. 5. The free end of the pantograph truss 20 is suspended from the cable by a sheave 58, and a block and tackle 59. When thus suspended, the pantograph truss is in position for rapid expansion to its full length as shown in FIG. 6. During its expansion, the pantograph truss is secured at one end to the cross bar 52 on the first mast 40 and its free end to the sheave supported block and tackle 59. Upon expansion of the pantograph bridge truss to its full length as shown in FIG. 6, the deck grate panels 21 are mounted into place to form the completed bridge truss structure.

Once fully assembled, the bridge truss and deck structure can be readily lifted from the masts and then lowered into place on appropriate premounted abutments by the use of block and tackle gear (not shown). The bridge thus formed is rigid and self sustaining and can be bolted or otherwise mounted to the abutments at each end thereof. Once assembled, the bridge is self sustaining and could likewise be utilized on suitable pontoons so as to be free floating. Once the bridge has served its purpose in a particular location, it is readily disassembled by reversing the above described procedure. The pantograph bridge truss can be collapsed after removing the deck grates, and the parts loaded back on to the transport trailer for movement to another location.

Figure 8:
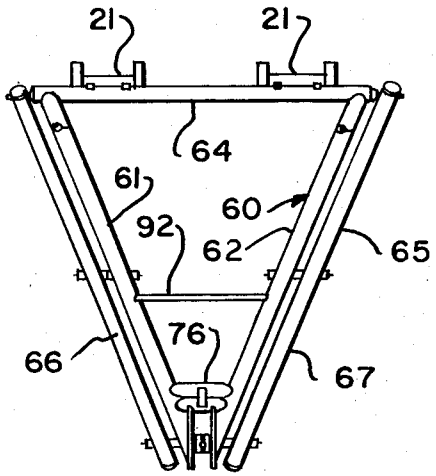
FIG. 8 is an end elevation view of the bridge truss section shown in FIG. 7.
Figure 7:
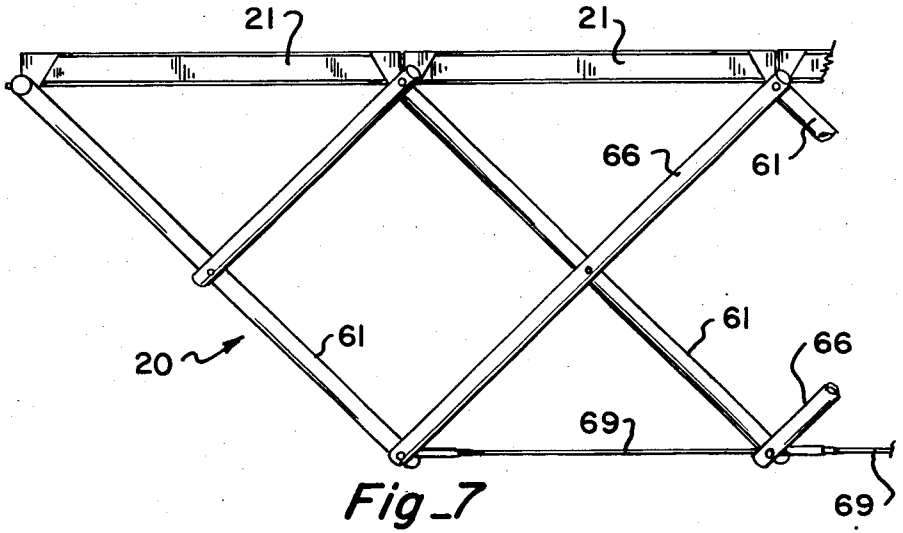
FIG. 7 is a fragmentary enlarged side elevation view of one end of the pantograph bridge truss shown in FIG. 6.
Figure 9:
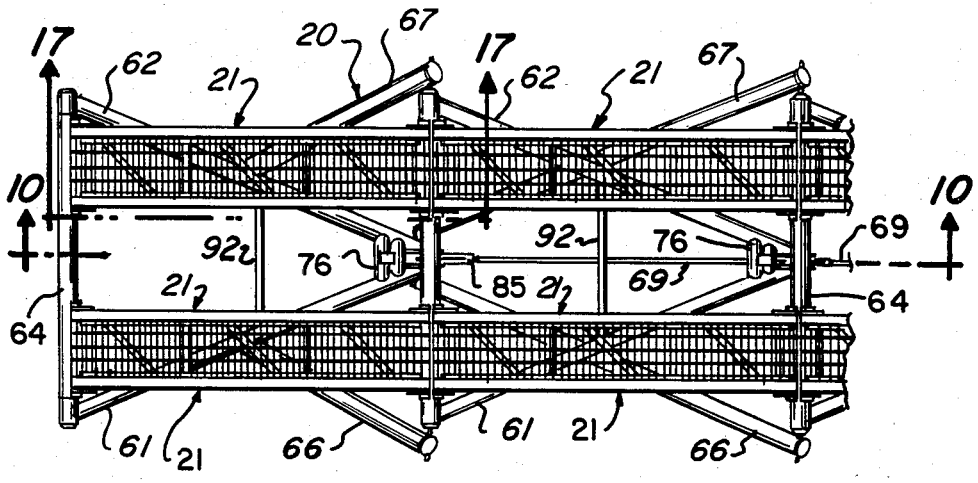
FIG. 9 is a plan view of the bridge truss section shown in FIG. 7.
Figure 10:
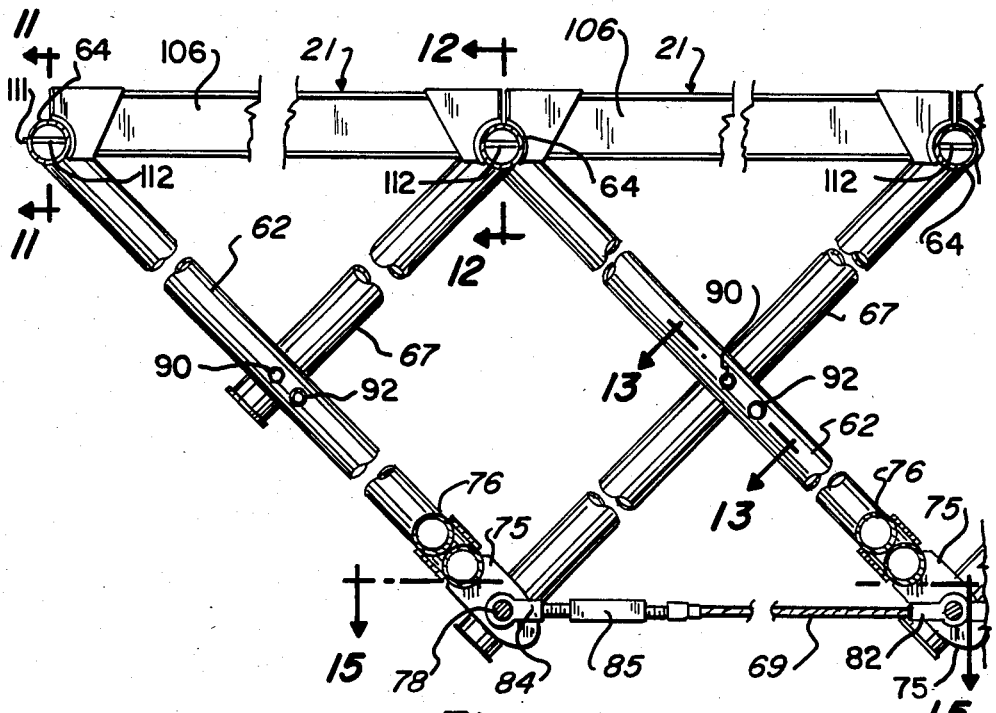
FIG. 10 is a further enlarged fragmentary elevation view of one end of the bridge truss shown in FIG. 9.

Turning to the pantograph or lazy tong bridge truss 20, the truss is shown generally schematically in FIGS. 7 and 8 and in more detail in FIGS. 9–19. The pantograph truss 20 is composed of generally inverted triangular bents or sections, that is the truss is a structure in which the base of each triangle bent is upward to define the horizontal deck plane of the truss, while the apex of each is generally downwardly. The triangular sections are pivoted together at their bases and apexes, with alternate sections pivoted together intermediate the sides of the legs, as shown in FIGS. 6, 7 and 8. The truss can thus be expanded to form a bridge or can be collapsed into a compact package for transportation.

The inverted triangular pantograph sections are of generally two types, the first being a unitary triangle 60 formed of a pair of legs 61, 62 joined together at one end to form an apex and at their other ends secured to a base 64. The second triangular section 65 is formed essentially of a pair of legs 66, 67 pivotally secured to the apex of the first triangle section 60 at one end and at their other ends pivotally secured to the base 64 of a second one of the first triangular sections 60. Intermediate their ends the legs 66, 67 are pivotally secured to still a third first-type triangular section 60. At the ends of the pantograph, the second legs 66, 67 are foreshortened so as not to extend the mid-point of a coupled triangular section 60, while at the other end of the truss, the first section 60 is foreshortened. By removing or adding triangular sections, the bridge can be lengthened or shortened. The extended length of the pantograph truss is determined by the length of cables 69 joining the apexes of adjacent triangular sections. The cables are flexible to permit the bridge truss to collapse for transportation while forming a expansion limiting device while the bridge is erected.

When the pantograph truss has been expanded to the length permitted by the cables 69, the decking panels are inserted between the transverse triangular base beams 64 by wedging the deck panels 21 tightly in place. In this manner, the bridge truss is expanded to the full extent permitted by the cables. This gives the truss a pretensioned configuration thereby preventing it from sagging under load. A rigid structure is thereby formed which is capable of carrying heavy sustained loads. Because the deck grates under load are in compression and the apex cables are in tension, loads are distributed uniformly over the entire bridge truss structure thereby enabling the truss to carry exceptionally heavy loads and with a load to truss weight ratio of in excess of 2 to 1.

Figure 11:
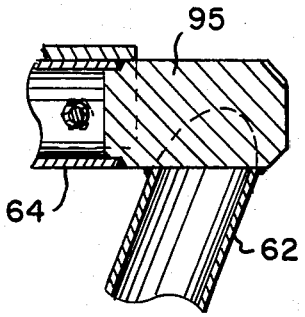
FIG. 11 is a section view taken substantially of the plane of line 11—11 on FIG. 10.
Figure 12:
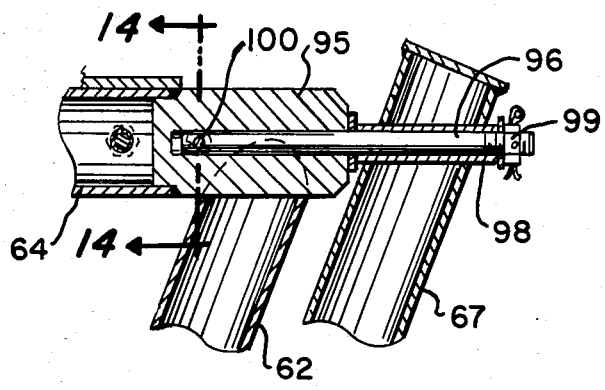
FIG. 12 is a section view taken substantially in the plane of line 12—12 on FIG. 10.
Figure 13:
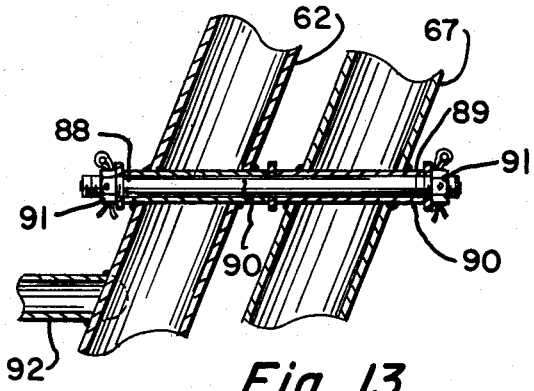
FIG. 13 is a section view taken substantially in the plane of line 13—13 in FIG. 10.
Figure 16:
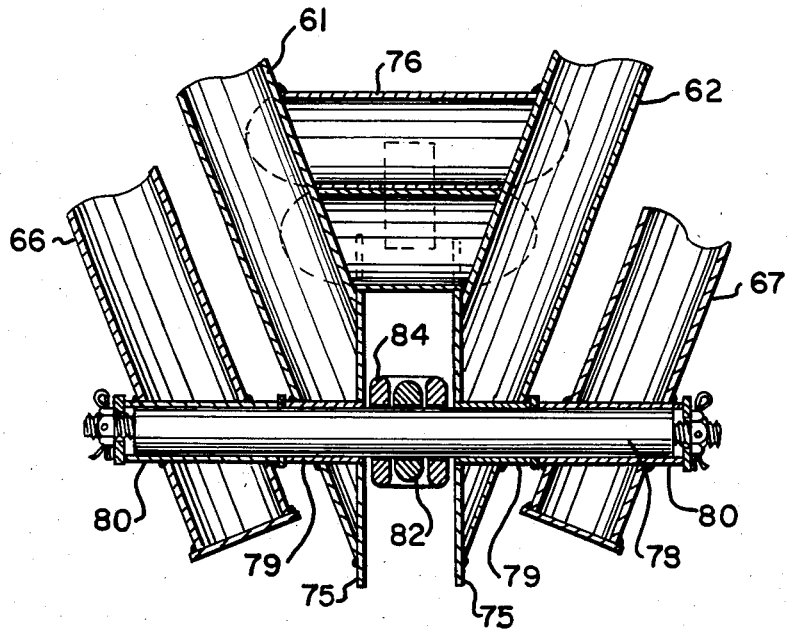
FIG. 16 is a section view taken substantially in the plane of line 16—16 on FIG. 15.
Figure 17:
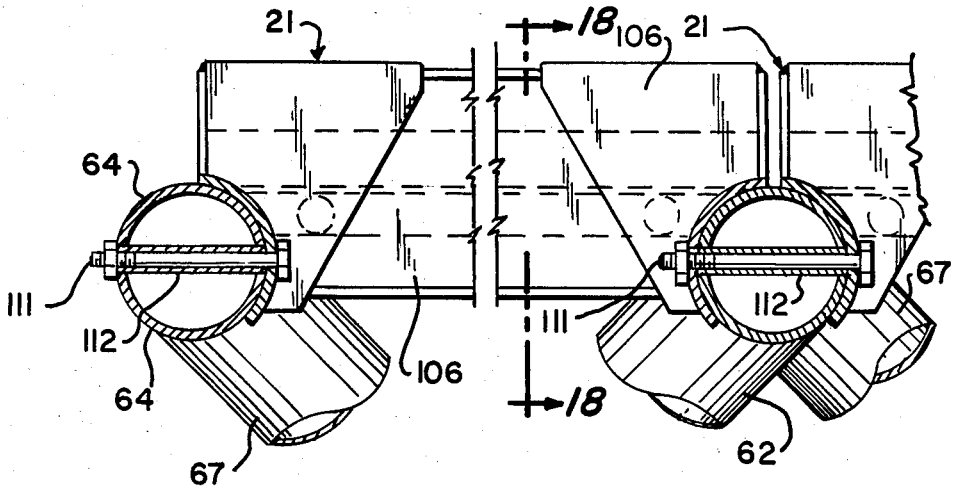
FIG. 17 is a section view taken substantially in the plane of line 17—17 on FIG. 9 but further enlarged to show details of the deck mounting.
Figure 19:
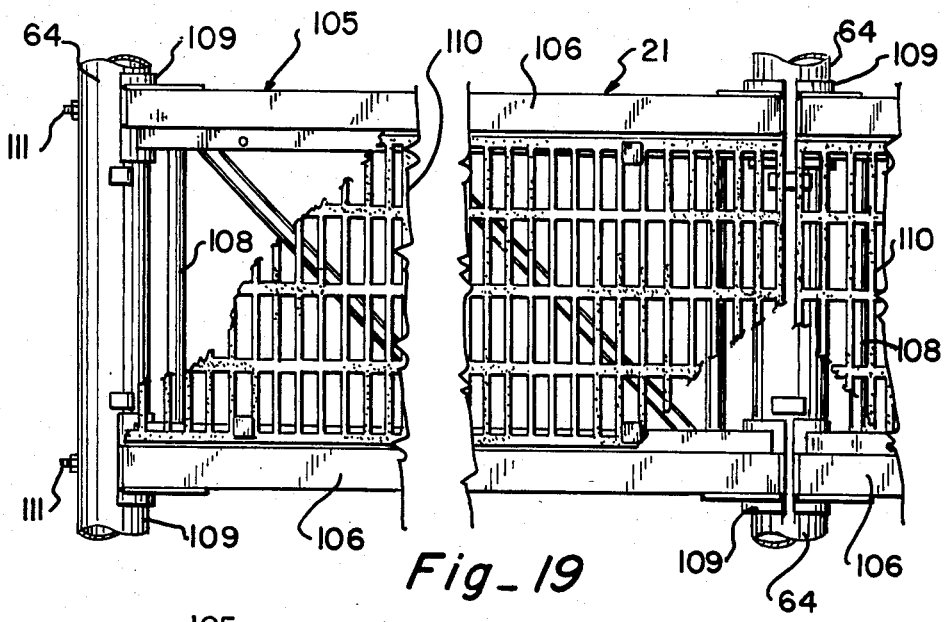
FIG. 19 is a plan view of a deck grate section as shown in FIG. 18.
Figure 18:
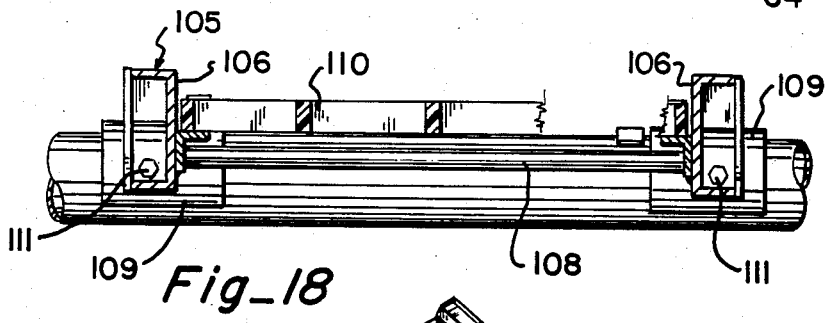
FIG. 18 is a section view taken substantially in the plane of line 18—18 on FIG. 17.

Turning to the details of construction of the pantograph truss and deck grate or panel sections, FIGS. 9–17 illustrate in detail segments of an erected bridge truss. Each structural member of the pantograph truss, whether a triangle leg or base, is formed as a sealed tube. All joints are tightly sealed in order that the tubes remain air-tight thereby providing flotation capabilities of the expandable truss. While it is not expected that the assembled bridge, including the deck grates would necessarily float, the expandable truss itself would at least either float or have a neutral buoyancy should it be necessary to erect the same in or over water. To this end, it will be noted from FIGS. 11 through 15 that all of the tubular sections are sealed both at the ends as shown in FIGS. 11, 12 and 16 and at all pivot points and junction points as shown in FIGS. 13 and 16.

The first triangular frame section 60 is formed with an apex joint as shown in FIG. 16. The side legs 61, 62 are closed at their apex ends by plates 75, the plates on each leg 61, 62 being spaced apart with the legs being joined by a cross brace 76 adjacent the plate ends. For receiving an apex pivot pin or shaft 78 the tubes are provided with journal sleeves 79 extending through and sealed to the tube ends. Similar journal sleeves 80 are provided at the apex ends of the second section legs 66, 67. The apex pivot pins 78 extend through the journals and include threaded end bolts 80 secured by appropriate washers and nuts. The apex cables are secured to the pivot pins 78 at each triangular apex section. To this end, each cable 69 is provided at one end with an eye bolt 82 and at its other end with a bifurcated eye bolt or clevis 84. Intermediate its ends, each cable 69 includes a turnbuckle adjustment mechanism 85. Referring to FIG. 16, the eye bolt 82 of one cable 69 and the clevis 84 of a second cable is mounted on each pivot pin 78. The length of each cable is adjustable to provide the desired tension by adjusting the turnbuckle 85 and then locking the turnbuckle in place by any appropriate locking device (not shown).

Intermediate their ends, each leg of the triangular sections is provided with a journal sleeve 88, 89 respectively, sealed therein and adapted to journal a pivot pin 90. The pivot pin is provided at each end with a fastening arrangement such as a screw and nut 91. The legs 61, 62 of the first triangular section 60 are also joined by an intermediate brace 92, as shown in FIG. 13.

Figure 14:
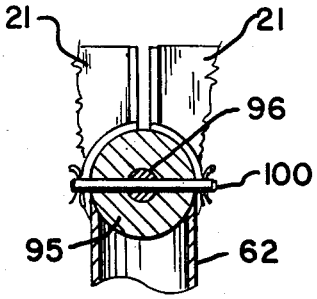
FIG. 14 is a section view taken substantially in the plane of line 14—14 on FIG. 12.
Figure 15:
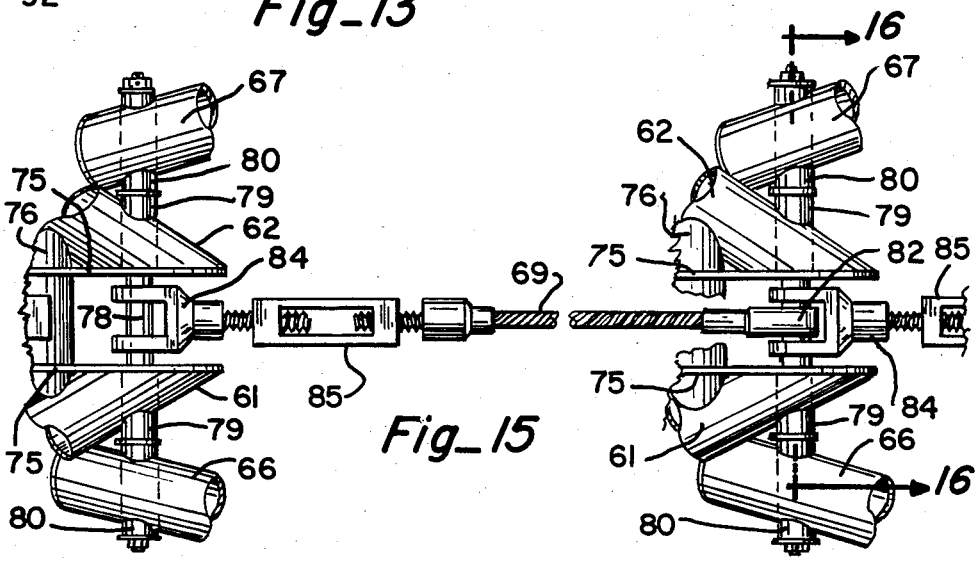
FIG. 15 is a section view taken substantially in the plane of line 15—15 on FIG. 10.

At their upper ends, the legs 61, 62 of the first triangular section 60 are joined to the transverse base tube 64. The transverse base tube 64 is sealed at each end with a sealing block or trunnion 95 to which the upper ends of the legs 61, 62 are secured. To provide a pivot point, the blocks 95 are provided with an extending pivot pin 96 which is received in a journal sleeve 98 extending in sealed relationship through the upper end of the legs 66, 67 of the second triangular section 65. An appropriate fastener 99 is provided at the end of each pivot pin 96. At the free ends of the truss where depending legs are not to be mounted, the pivot pin 96 can be omitted as shown in FIG. 11. The pivot pin 96 is secured in the mounting block 95 by an appropriate locking pin 100 as shown in FIG. 14, the pin 100 extending through the block 95 into engagement with an inserted end of the pivot pin 96.

When the bridge truss has been extended, the deck grating sections 21 are inserted into place. Each deck grating 21 comprises a generally rectangular frame 105 formed by spaced parallel side rail members 106 joined by transverse end braces 108. At each end, the longitudinal side rails 106 are provided with a generally "C" shaped bracket 109 adapted to wrap partially around and receive a tubular base beam of each triangular bridge section. The "C" shaped brackets 109 wrap around the transverse tubes 64 through an arc of slightly more than 90 degrees in order that the deck grate sections are securely held in place. Intermediate the rails 106 of each deck section, there is provided a grating 110 which may be of metal or plastic impregnated Fiberglas. When mounted in place, the deck sections are secured to the pantograph bridge truss by bolts 111 which extend through and are secured to the "C" shaped mounting brackets 109. To provide a seal, appropriate journal sleeves 112 are provided in each transverse tube 64 to receive the bolts 111.

Figure 20:
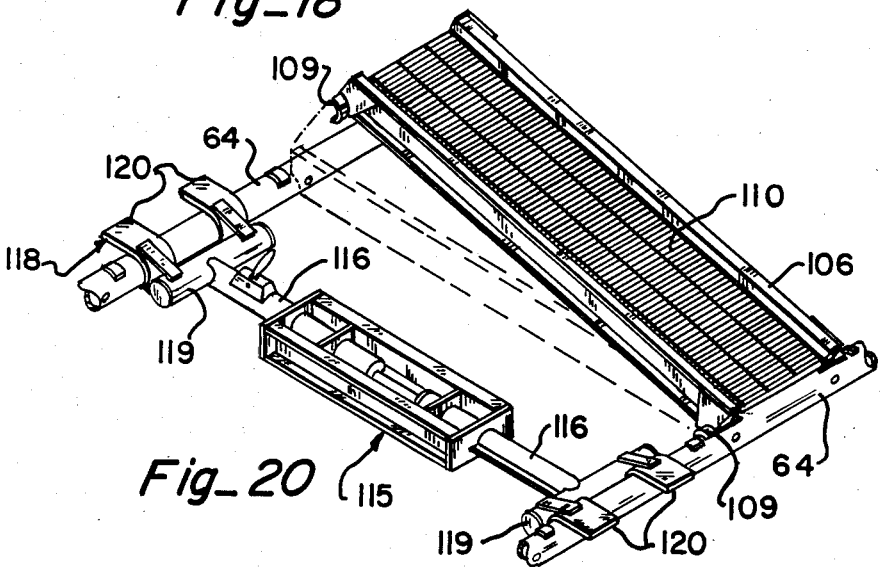
FIG. 20 is a fragmentary view showing a jack structure for use in insertion of a deck grate section.

In order to facilitate the mounting of the deck sections in place, means are provided for separating or slightly increasing the distance between adjoining transverse tubular members 64 while the deck section is inserted into place. When the deck section has been inserted into place, the expansion force can be released thereby allowing the tension of the cables 69 to retain the deck sections tightly in place. At the same time the deck sections provide a rigid structural effect to retain the bridge in its extended, prestressed position. One illustrative expansion mechanism is shown in FIG. 20 and comprises an hydraulic or mechanical jack 115 having extending piston rods 116 at each end thereof. Each rod carries a generally "C" shaped bracket 118 adapted to be positioned over a transverse bridge member. Each bracket comprises transverse "T" or cross bar 119 carrying at each end a generally "C" shaped prong or finger 120 adapted to rest on top of a transverse bridge beam 64. By dropping the jack in place between two transverse beams 64 and then actuating the jack 115, the beams 64 are spread slightly to allow room for a bridge deck panel section 21 to be dropped into place, as shown in FIG. 20. When the deck section 21 is in place, the jack pressure is released and the jack moved to a successive location. The deck sections are thus rapidly and quickly assembled in place and, once in place, are securely locked thereto both by the action of the "C" clamps as well as by the safety bolts 111.

The bridge when erected is in a prestressed condition by virtue of the tension in the cables 69 and the length of the rigid deck section grate structure. The bridge is capable of carrying several times its weight and yet is adapted to be readily disassembled for transportation and erection at a different site. The bridge is capable of being rapidly deployed in a matter of a few hours with only a minimum crew. The bridge structure itself is light in weight so that it is readily transportable over both highways and difficult terrain and is particularly adapted for use in a military environment.

While an illustrative embodiment of the present has been shown in the drawings and described in considerable detail, it should be understood that there is no intention to limit the invention to the specific form disclosed. On the contrary the intention is to cover all modifications, alternative constructions, equivalents and uses falling within the spirit and scope of the invention as expressed in the appended claims.

We claim:

1. A portable bridge adapted to be carried on and erected into place from a wheeled vehicle, comprising in combination, a plurality of triangular bents, means pivotally connecting said bents into a pantograph truss with said triangular bents in inverted juxtaposition with the bases of the triangular bents defining an upper horizontal plane, adjustable length cables connecting the apexes of said triangular bents to limit the extension of said truss and tension the same, and a plurality of removable deck panels adapted for releasably engaging and holding apart the bases of adjoining triangular bents to hold the truss tensionally in its extended configuration and define a generally horizontal deck on said truss.

2. A portable bridge adapted to be carried on and erected into place from a wheeled vehicle, comprising in combination, a plurality of triangular bents, means pivotally connecting said bents into a pantograph truss with said triangular bents in inverted juxtaposition with the base of the triangular bents defining an upper horizontal plane, adjustable length cables connecting the apexes of said triangular bents to limit the extension of said truss and tension the same, and a plurality of removable deck panels adapted for releasably engaging and holding apart the bases of adjoining triangular bents to hold the truss tensionally in its extended configuration and define a generally horizontal deck on said truss, the legs and base of each triangular bent being formed of sealed tubes, and means defining pivot journal sleeves in each bent for receiving pivot pins for pivoting the sections of the pantograph bridge truss together.

3. A portable bridge comprising, in combination, an expandable and retractable pantograph bridge truss, a plurality of deck plates insertable in and removable from said truss, a pair of erecting masts adapted to be vertically supported in spaced apart relation, a cable adapted to extend between the upper ends of vertically positioned spaced masts, and means for suspending said expandable truss from said cable for expansion or retraction from or to one of said masts and for raising or lowering said expandable bridge truss relative to said masts for mounting said bridge in place or removing said bridge from a mounting, said pantograph truss comprising a plurality of inverted triangular shaped units defining first and second triangular frames, each first triangular frame having a pair of legs joined together at one end to define an apex and at their opposite ends joined to a transverse horizontal base bar, each second triangular frame having a pair of legs pivotally secured at one end at the apex of said first triangular frame and pivotally secured at their opposite ends to the ends of a transverse base of another first triangular frame, said legs of said first and second triangular frames being pivotally secured intermediate their ends to corresponding legs of adjoining second and first triangular frames respectively to form said pantograph truss, said deck plates each comprising a generally elongated rectangular panel having relatively short end edges and relatively longer side edges and adapted to be forcibly inserted between pairs of said horizontal base bars for holding said truss in expanded form, said panels including means on the short edges thereof for engaging said base bars, and flexible restraining cables engaged between the apexes of said truss frames for limiting the expansion of said truss when said deck plates are mounted in place.

4. A portable bridge comprising, in combination, an expandable and retractable pantograph bridge truss, a plurality of deck plates insertable in and removable from said truss, said pantograph truss comprising a plurality of inverted triangular shaped units defining first and second triangular frames, each first triangular frame having a pair of legs joined together at one end to define an apex and at their opposite ends joined to a transverse horizontal base bar, each second triangular frame having a pair of legs pivotally secured at one end at the apex of said first triangular frame and pivotally secured at their opposite end to the ends of a transverse base of another first triangular frame, said legs of said first and second triangular frames being pivotally secured intermediate their ends to corresponding legs of adjoining second and first triangular frames respectively to form said pantograph truss, and said deck plates each comprising a generally elongated rectangular panel having relatively short end edges and relatively long side edges and adapted to be forcibly inserted between pairs of said horizontal base bars for holding said truss in expanded form, said panels including means on the short edges thereof for releasably engaging said base bars, and flexible restraining cables engaged between the apexes of said truss frames for limiting the expansion of said truss when said deck plates are inserted in place.

5. A bridge as defined in claim 4 wherein the apex of said first triangular frame comprises a pair of legs in spaced juxtaposition and a brace secured to each leg spacedly adjacent the ends thereof.

6. A bridge as defined in claim 4 wherein said cables each include turnbuckles for adjusting the length of said cables.

7. A portable bridge as defined in claim 4 wherein said deck sections are inserted into place by forcibly expanding the spacing between adjacent frame members by application of a separating force in opposition to the tension on said cables to allow said deck sections to be inserted into place and thereafter withdrawing said separating force whereby said deck sections remain firmly clamped in place.

8. A bridge as defined in claim 7 wherein said separating force is exerted by a double ended jack acting between adjacent triangular frame bases.

9. A bridge as defined in claim 4 wherein each said deck plate comprises a generally rectangular frame, a grating supported by said frame, and generally "C" shaped brackets at each corner of said frame for engagement with the horizontal bridge truss frame members forming the bases of said inverted triangular frame sections.

10. A bridge as defined in claim 9 wherein said deck plates are bolted to said pantograph truss after insertion into place between said frame bases.

11. A portable bridge as defined in claim 10 including pivot pins for joining inverted triangular sections together to form said pantograph, each structural element of said bridge including journals sealably mounted therein for receiving said pivot pins.

12. A bridge as defined in claim 9 wherein each said triangular frame is formed of sealed tubular members.

13. A bridge as defined in claim 12 wherein said sealed tubular members are generally annular in cross section.

* * * * *